US006572519B1

(12) United States Patent
Harris

(10) Patent No.: US 6,572,519 B1
(45) Date of Patent: Jun. 3, 2003

(54) CREASING DEVICE

(76) Inventor: Graham Harris, 2 Hudson Close, Whetstone, Leicester LE8 6EU (GB)

( * ) Notice: Subject to any disclaimer, the term of this patent is extended or adjusted under 35 U.S.C. 154(b) by 0 days.

(21) Appl. No.: 09/936,851

(22) PCT Filed: Feb. 17, 2000

(86) PCT No.: PCT/GB00/00565

§ 371 (c)(1),
(2), (4) Date: Sep. 14, 2001

(87) PCT Pub. No.: WO00/55080

PCT Pub. Date: Sep. 21, 2000

(30) Foreign Application Priority Data

Mar. 17, 1999 (GB) ..... 9906132

(51) Int. Cl.[7] ..... B31F 1/00
(52) U.S. Cl. ..... 493/395; 493/403
(58) Field of Search ..... 493/405, 406, 493/416, 417, 442, 445, 454, 59, 60, 63, 64, 402, 403, 395, 396, 475; 227/188, 209; 100/175

(56) References Cited

U.S. PATENT DOCUMENTS

| | | | | | |
|---|---|---|---|---|---|
| 859,354 | A | * | 7/1907 | Buttress | 209/448 |
| 1,000,139 | A | * | 8/1911 | Wyman | 493/396 |
| 1,089,402 | A | * | 3/1914 | Downing | 493/396 |
| 1,186,970 | A | * | 6/1916 | Cottrell | 270/41 |
| 1,196,912 | A | * | 9/1916 | Weck | 493/396 |
| 1,302,831 | A | * | 5/1919 | Naugler | 493/396 |
| 3,157,398 | A | * | 11/1964 | Zahradnik | 493/397 |
| 3,314,339 | A | * | 4/1967 | Guffy et al. | 493/403 |
| 3,545,371 | A | * | 12/1970 | Reist | 100/176 |
| 3,577,822 | A | * | 5/1971 | Sauer et al. | 101/415.1 |
| 3,977,310 | A | * | 8/1976 | Keck et al. | 493/204 |
| 3,981,213 | A | * | 9/1976 | Lopman | 493/60 |
| 4,289,492 | A | * | 9/1981 | Simpson | 493/371 |
| 4,359,217 | A | * | 11/1982 | Roller et al. | 271/186 |
| 4,367,061 | A | * | 1/1983 | Wiholm | 412/3 |
| 4,375,971 | A | * | 3/1983 | Moll | 100/176 |
| 4,417,883 | A | * | 11/1983 | Granger et al. | 493/403 |
| 4,596,541 | A | * | 6/1986 | Ward et al. | 493/354 |
| 5,154,410 | A | * | 10/1992 | Baader et al. | 271/188 |
| 5,158,525 | A | * | 10/1992 | Nikkel | 384/248 |
| 5,194,064 | A | * | 3/1993 | Simpson et al. | 493/402 |
| 5,280,901 | A | * | 1/1994 | Smith et al. | 271/188 |
| 5,529,563 | A | * | 6/1996 | Veith et al. | 493/395 |
| 5,888,183 | A | * | 3/1999 | Ruthenberg et al. | 493/160 |

* cited by examiner

*Primary Examiner*—Rinaldi I. Rada
*Assistant Examiner*—Louis Tran
(74) *Attorney, Agent, or Firm*—Cherskov & Flaynik

(57) ABSTRACT

The invention is a creasing device for creasing paper or card before it is folded. The device consists of a drum-shaped male component (2) featuring grooves (8, 10, 12) of various widths and depths to hold rubber O-rings (24, 26, 28). A female component (4) is almost identical to the male component (2) but has receiving grooves (14, 16, 18) that are slightly wider and deeper. When fixed to top and bottom shafts with one O-ring (24, 26, 28) in a groove (8, 10, 12) on the male component (2) aligned with a receiving groove (14, 16, 18) of the female component (4), a sheet of paper fed between the drums will be creased by the pressure of the O-ring (24, 26, 28) forcing the paper into the receiving groove (14, 16, 18). The invention allows the device to be quickly and easily set up to form creases of various widths and depths, while the resilient O-rings minimize damage to the paper.

7 Claims, 1 Drawing Sheet

CREASING DEVICE

DESCRIPTION

1. Technical Field

This invention relates to a creasing device for creasing paper or card before it is folded.

2 . Background

A high percentage of printed stock such as book covers or greetings cards needs to be creased before the next operation of folding can be carried out.

Existing methods of creasing involve feeding the paper to be creased between an upper drum and a pair of lower drums. A metal disc is affixed to the upper drum and projects a short distance radially outwards around the circumference of the upper drum. The two lower drums are mounted coaxially and are spaced apart a short distance to create a narrow gap between them. The disc projecting from the upper drum is received in the gap between the two lower drums. When the upper and lower drums are counter-rotated and paper is fed between them, the projecting disc forces the paper into the gap, deforming it into the desired crease.

This method has the disadvantage that mounting of the metal disc on the upper drum is slow. Obtaining the correct spacing between the two lower drums and aligning it correctly with the disc is critical to the success of the operation and is a skilled operation. Also, the metal disc can damage the paper, particularly causing it to tear at the edges.

A very small percentage of printers will have in-house facilities to tackle the creasing operation. Most medium sized printers, for example, will regularly send such work out to be processed at a specialized print finishers.

Even so, a high degree of this work is then cut to size on a guillotine and then processed for a second time through a folding machine (common to most printers). Although the carrying out of these operations are priced into the job, accordingly, the long drawn out system can often cause a delay in its delivery to the customer and an increase in costs.

SUMMARY OF THE INVENTION

The invention is a creasing device consisting or a drum-shaped male component featuring grooves of variable widths and depths to hold rubber O-rings or inserts. The female component is almost identical to the male component, apart from the grooves being slightly wider and deeper. When fixed to the top and bottom shafts of the unit with one O-ring or insert on the male component aligned with a groove of the female component, a sheet of paper fed between them will be creased by the pressure of the O-ring or insert forcing the paper into the groove.

According to the present invention the specialized processes described in the "Background" can be eliminated. The first unit of a commonly used folding machine can be adapted to mount the male and female components to operate the creasing method. By using different O-rings or inserts and/or different grooves on the male component, the device can quickly and easily be adapted to form different widths and depths of creases in different thicknesses of paper. The grooves in the female component are automatically aligned with the corresponding O-rings or inserts in the male component.

The rubber O-rings or inserts treat the paper more gently and are less likely to tear it than the metal discs of the prior art. Hardened rubber or a similar resilient material is chosen to avoid wear. Once worn, the rings can be quickly and easily replaced.

THE DRAWINGS

Figure 1:
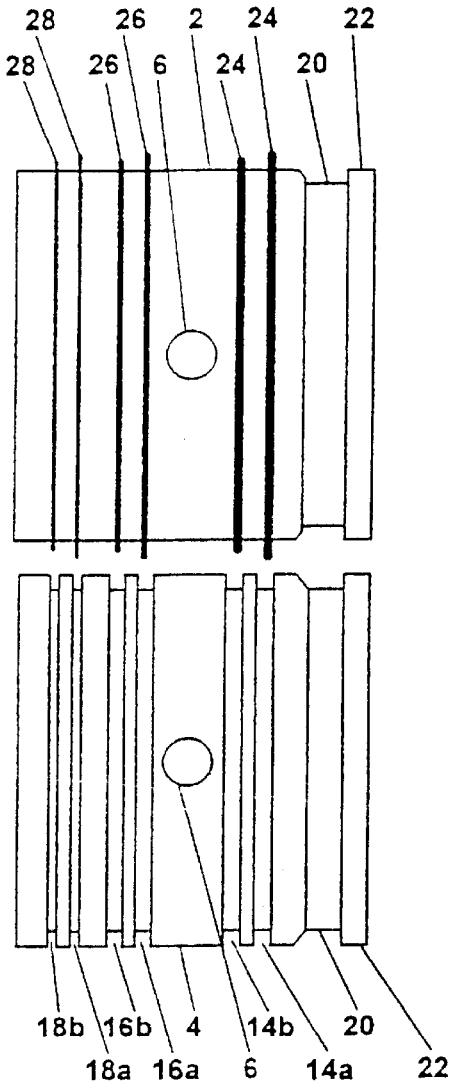
FIG. 1 shows the male component with all its O-rings, aligned with the female component.
Figure 2:
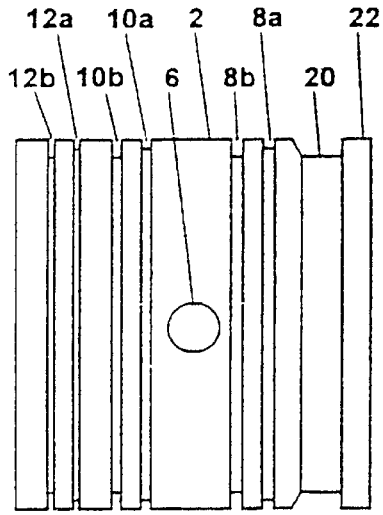
FIG. 2 shows just the male component without any O-rings.

FIG. 1 shows the male component 2 aligned with the female component 4. Each component has a cylindrical bore along its axis (not shown) for mounting on a shaft. The component is secured to the shaft with a screw 6. As visible in FIG. 2, the surface of the male component has grooves around its circumference. As shown, there is a pair of wide (e.g. 1.5 mm) grooves 8*a*,8*b*, a pair of medium width (e.g. 1 mm) grooves 10*a*,10*b* and a pair of narrow (e.g. 0.5 mm) grooves 12*a*,12*b*. Of each pair, one groove (8*a*,10*a*,12*a*) is shallower than the other groove (8*b*,10*b*,12*b*).

The female component has a set of grooves aligned with the ones on the male component. Thus there is a pair of wide grooves 14*a*,14*b*, a pair of medium width grooves 16*a*,16*b* and a pair of narrow grooves 18*a*,18*b*. Each groove on the female component is wider and deeper than the corresponding groove on the male component. The grooves on the female component can all be the same depth.

Figure one shows the male component with all the O-rings in place simultaneously. In practice, only one O-ring would be used at a time. The unused O-rings can be stored in the channel 20. The female component is also shown with a channel 20. This is not needed for the storage of O-rings and can either be omitted or be retained so as to define a land 22 which is useful for aligning the male and female components.

In the illustrated device, there are three O-rings 24,26,28, corresponding to the widths of the three pairs each groove is such that, when an O-ring rests in it, the O-ring projects above the surface of the male component. When the O-ring is in the shallower groove of each pair, it projects further above the surface. An O-ring of round cross-section may not be suitable for the narrowest grooves because the grooves would have to be extremely shallow for the O-ring to project above the surface. Instead, a more flattened resilient insert shaped like a washer may be used.

In operation, the desired width of crease may be determined by selecting the appropriate O-ring and placing it in one of the corresponding pair of grooves on the male component. The grooves and O-rings may be colour coded to assist with matching them. The desired depth of crease may be determined by selecting the deeper or shallower one of the pair of grooves.

The male and female components are mounted on their shafts and aligned, using the land 20 if necessary. They are placed closer together than shown in FIG. 1, so that the O-ring on the male component 2 is received in the groove in the female component 4.

Of course, the number of widths of O-rings and grooves provided could be different, as could the number of depths of groove for each width.

What is claimed is:

1. A device for creasing paper, comprising:

a first drum with an axis and having an outer surface comprising around circumferences of the surface one or more first grooves of a first width and a first depth;

a second drum with an axis and having an outer surface comprising around circumferences of the surface, one or more receiving grooves of a width greater than the first width; and one or more first resilient creasing rings for location in the grooves of the first drum to project radially outwards from the outer surface of the first drum to a first height;

such that, when the first and second drums are located adjacent to one another, with their axes parallel, first resilient creasing rings projecting from the first drum can lie within the receiving grooves of the second drum to form creases in a sheet of paper fed between the first and second drums.

2. A device according to claim 1, wherein the first drum further comprises one or more shallow grooves of a second depth less than the first depth so that said one or more resilient creasing rings, when located in the shallow grooves, project from the surfaces of the first drum to a second height greater than the first height.

3. A device according to claim 1, wherein the first drum further comprises one or more narrow grooves of a second width less than the first width, the device further comprising second resilient creasing rings narrower than the first resilient creasing rings for location in the narrow grooves of the first drum to project radially outwards from the outer surface of the first drum.

4. A device according to claim 3, further comprising a channel formed around the circumference of the outer surface of the first drum for storing the resilient creasing rings when not located in the grooves.

5. A device according to any of claims 2 to 4, wherein for each groove (8,10,12) in the first drum (2), the second drum (4) has a receiving groove (14,16,18) of greater width at a corresponding axial position.

6. A device according to claim 5, wherein the second drum (4) further comprises means for positioning the second drum (4) relative to the first drum (2) in the axial direction.

7. A device according to claim 1, wherein each resilient creasing ring has a cross-section and the cross-section of one or more of the resilient creasing rings is thicker in a direction perpendicular to the surface of the drum than in a direction parallel to the surface of the drum.

* * * * *